US006790337B1

(12) United States Patent
Vestre et al.

(10) Patent No.: US 6,790,337 B1
(45) Date of Patent: Sep. 14, 2004

(54) METHOD AND DEVICE FOR OPERATING AN ELECTROLYTIC CELL

(75) Inventors: Silja Bjerke Vestre, Oslo (NO); Morten Karlsen, Øvre Årdal (NO)

(73) Assignee: Norsk Hydro Asa, Oslo (NO)

( * ) Notice: Subject to any disclaimer, the term of this patent is extended or adjusted under 35 U.S.C. 154(b) by 228 days.

(21) Appl. No.: 10/129,985

(22) PCT Filed: Nov. 15, 2000

(86) PCT No.: PCT/NO00/00384

§ 371 (c)(1),
(2), (4) Date: Sep. 16, 2002

(87) PCT Pub. No.: WO01/36716

PCT Pub. Date: May 25, 2001

(30) Foreign Application Priority Data

Nov. 17, 1999 (NO) ..... 995633

(51) Int. Cl.[7] ..... C25C 3/22
(52) U.S. Cl. ..... 205/391; 204/247
(58) Field of Search ..... 204/247; 205/391

(56) References Cited

U.S. PATENT DOCUMENTS 3,935,090 A * 1/1976 Petrusenko et al. ..... 204/247
5,128,012 A 7/1992 Olsen
5,961,812 A 10/1999 Bouzat et al.

FOREIGN PATENT DOCUMENTS

GB 2158226 11/1985
SE 412768 3/1980
WO 9522640 8/1995

OTHER PUBLICATIONS

Derwent's abstract, No. 11029 D/07, week 8107, Abstract of SU, 734313 (Alum Magn Electr Ind), May 15, 1980.

* cited by examiner

*Primary Examiner*—Roy King
*Assistant Examiner*—Harry D. Wilkins, III
(74) *Attorney, Agent, or Firm*—Wenderoth, Lind & Ponack, LLP

(57) ABSTRACT

The present invention concerns a method and device for reducing emissions of process gases from Hall-Héroult cells to the ambient air. The cells comprise an anode superstructure (1) with covers which can be opened for access to the cell's anodes, among other things. The anode superstructure comprises an extraction system for the removal of process gases, which extraction system is adjusted to remove a standised quantity of process gases during normal operation of the cell. The extraction system is designed so that an increased quantity of process gases is removed when the covers of the anode superstructure are opened. One embodiment of the present invention includes a vertical partition wall (10') which is located inside the anode superstructure and contributes to an improved flow pattern in the anode superstructure.

7 Claims, 2 Drawing Sheets

METHOD AND DEVICE FOR OPERATING AN ELECTROLYTIC CELL

Figure 1:
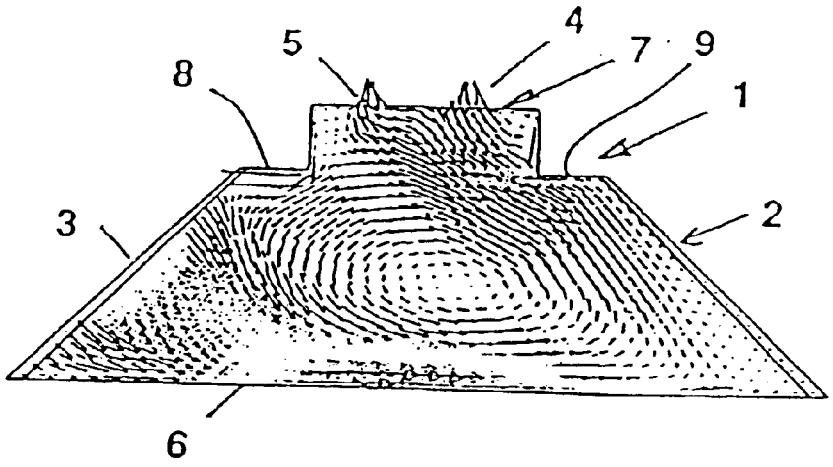

The present invention concerns the operation of electrolytic cells of type Hall-Héroult. More precisely, the present Invention relates to improved control of process gases and limitation of emissions of process gases into the hall atmosphere during maintenance on the cells.

The upper part of an electrolytic cell of type Hall-Héroult usually comprises an anode superstructure consisting of covers or an enclosure including a gas extractions system. Some auxiliary equipment may also be attached such as an anode beam with jacks, crust breakers and a system for raw material dosing inside the superstructure. In order to make the anode superstructure as gastight as possible, covers are constructed which are designed to separate the hall atmosphere from the process gases. The task of the covers is to preserve/increase the underpressure inside the anode superstructure in connection with a given gas extraction. This will lead to the process gases being transported into the anode superstructure and on out to collection channels to a greater or lesser extent, depending on the design of the system. At a constant extraction quantity, the system must be dimensioned so that opening the covers entails a limited emission of process gases to the hail atmosphere in order that the air of the working environment is not of too poor quality.

GB 2158226 discloses extraction of gases from an electrolysis cell, where the cell's superstructure is provided with a plurality of evacuating means. Said means are arranged successively in the longitudinal direction of the superstructure, and each of them have provisions for controlling the flow of the extracted gas and to registrate the temperature of same. The opening of a cell cover will activate an increased suction extraction mode in the actual evacuating means in response to a drop in the temperature of the extracted gas passing therethrough. This solution is thus dependent upon the occurrence and registration of cold gas in the duct of at least one of the evacuating means to increase the extraction of gases from the cell. One problem with this solution is that the cold gas that enters the cell through an opened cover, will tend to "fall" down towards the crust of the cell and be heated up on Its way towards the evacuating means. Followingly there may be a severe delay in the activation of the increased suction depending upon the internal gas flow patterns in the superstructure of the cell. This will subsequently represent a risk of outflow of process gases from the cell to its surroundings. Further, as this principle of extraction is based on activation/deactivation of increased suction in relation to measured temperature at plural points within the superstructure, extraction may be activated at non-optimal locations initiating turbulent flow patterns allowing process gases to escape from the uncovered opening.

WO 95/22640 relates to an arrangement for closing and cooling the top of an anode casing for a Søderberganode. The top of the anode casing is equipped with at least one cover having openings for the contact bolts and at least one off-gas opening. The amount of gas removed from the top of the anode through the off-gas opening is controlled in such a way that a sufficient diminished pressure is provided in the top of the anode that surrounding air will flow through air gaps arranged between the cover and each of the contact boltse. This flow will be in such an amount that gas from the top of the anode does not escape through the air gaps and to keep the temperature of the top of the anode calling below a preset temperature. It is further disclosed that the anode top may include plural side covers, but it is not indicated any increased suction extraction when the covers are opened.

The present invention concerns improvements in the extraction of process gases from electrolytic cells, whereby the disadvantages of the prior art can be avoided. Moreover, the present invention comprises improvements in the flow pattern of the gas inside the anode superstructure, which means that it is possible to achieve improved extraction conditions even with a reduced extraction quantity.

Figure 2:
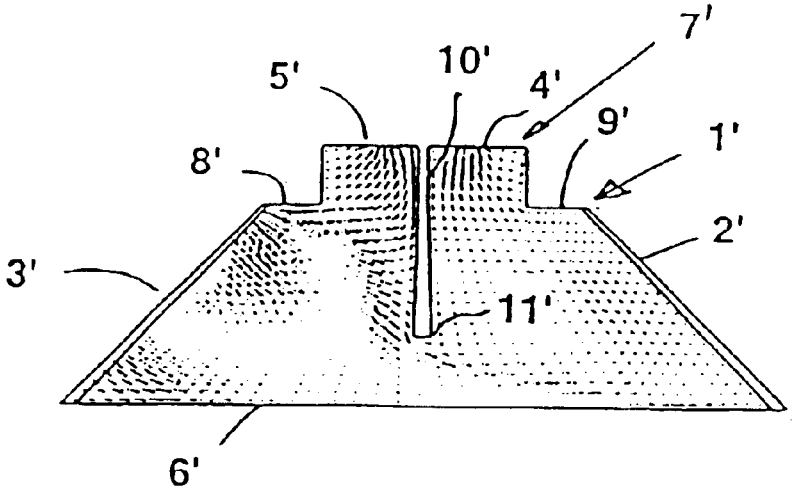
Figure 3:
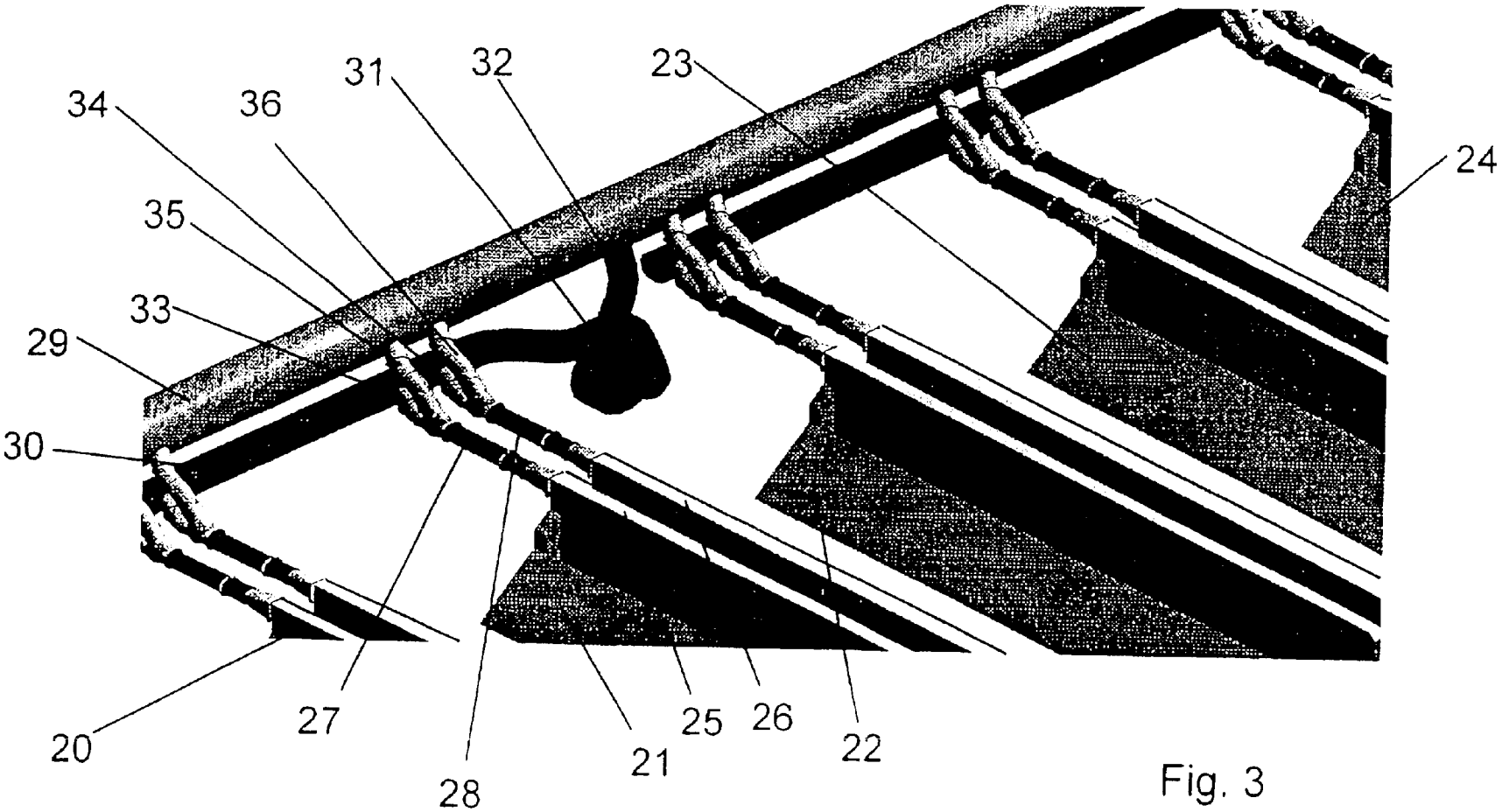

The present invention will be described in the following using examples and figures, where:

FIG. 1 shows a diagram of flow vectors in an anode superstructure with two extraction openings FIG. 2 shows a diagram of flow vectors in an anode superstructure with two extraction openings and a flow director, FIG. 3 shows details of an extraction system for use in accordance with the present invention.

FIG. 1 shows an anode superstructure 1 with sides 2, 3, a bottom 6, which faces down towards the electrolysis vessel (not shown), a top 7 with extraction openings 4, 5 and gas collecting hoods 8, 9.

The gas extraction system or, more precisely, the gas channels on the anode superstructure can be divided into two separate systems (right/left) which go out to a collection channel which is preferably arranged along the hall wall. Each system has two modes, a normal mode and a forced mode. The size of the normal extraction depends on the current of the electrolytic cell, while the forced extraction may be three times the normal extraction in a "standardised" quantity. Although the gas collection system on the anode superstructure can be divided into two separate parts, it has a common denominator, namely that the overall system works in the same pressure vessel defined by the degree of protection of the electrolytic cell and is generally defined by the cover design and opening area.

The sides 2, 3 may comprise one or more removable covers (not shown) which allow access to the interior of the anode superstructure. When one or more covers are removed from the anode superstructure in order to carry out manual work on the cell, the air which flows in will be much colder than the air already inside the anode superstructure (furnace chamber). Cold air will fall down, producing the phenomenon called "cold slip". On account of the extraction which is always applied to the furnace chamber, the air will flow where there is least resistance, i.e. in the hole where the covers have been removed. Calculations show that over 80% of all air which is extracted will take the path of least resistance through the hole in the enclosure.

The inflowing cold air will fall down and sweep over the anode carbons and the cover material on the anodes (not shown) and will thus be mixed with process gas while at the same time being heated. On account of the acceleration of the cold air as it falls, the speed will increase and the incoming air will flow over to the opposite side of the furnace chamber. Here it (the cold slip) will meet air which has been sucked in from the opposite side and the majority of the air which comes from the hole in the enclosure will be forced up and into the extraction system. The remaining air which has now been heated and mixed with process gas will be returned to the side where the covers have been removed by large circular flow patterns being established in the cell as shown in FIG. 1.

It can be seen from the flow pattern shown in FIG. 1 that the above-mentioned "cold slip" generates a vacuum where the gas enters and falls down in the cell. This, in combination with the flow pattern generated in the cell, will lead to the establishment of a speed vector which is in the opposite direction (out of the anode superstructure) under or at the gas collecting hood 8 of the cell The vacuum generated is filled with hot process gas on account of the large circular flows in the cell. The result of the flow pattern shown in FIG. 1 is that process gas can be pressed out of the anode superstructure and escape to the hall atmosphere with associated increased roof emission and not least increased exposure of the operators to process gases. By forcing or increasing the extraction quantity in connection with opening one or more covers, it will be possible, in accordance with the present invention, to reduce the quantity of process gas emitted to the hall atmosphere.

FIG. 2 shows an anode superstructure 1' in accordance with the present invention, which superstructure comprises sides 2', 3', a bottom 6', which faces down towards the electrolysis vessel (not shown), a top 7' with extraction openings 4', 5' and gas collecting hoods 8', 9'. The sides 2', 3' may comprise one or more removable covers (not shown) which allow access to the interior of the anode superstructure. Moreover, the anode superstructure comprises a central flow director 10'.

By introducing a flow director in the form of a mainly vertical partition wall, for example of steel plate (St 37 steel) with 10 mm plate thickness and with a given distance from the lower edge of the partition wall to the surface of the cathode in the electrolysis vessel, for example 1000 mm, and which also as a maximum covers the area from one end to the other in the anode superstructure, it will be possible to establish a changed, more optimal flow pattern in the anode superstructure. The flow director 10' will lead to dramatic changes with regard to the potential for removing/draining process gases from the anode superstructure to the extraction system for further processing. The working environment will be improved in connection with the performance of manual work on the electrolytic cells. The location of the flow director 10' in the centre of the furnace chamber at a suitable distance from the base of the cathode and thus the crust over the bath will allow it act as a flow director for the process gases and is of particular importance in connection with the performance of manual work on the cell for which the side covers must be opened.

When changing the carbon or in connection with routines in which up to three covers are removed from the anode superstructure and forced extraction is on, the partition wall which is mounted in the centre of the furnace chamber will act as a flow director in that passing gas which, on account of the "cold slip", flows under the partition wall, is caught by the gas extraction 4' working on the opposite side. It will no longer be possible to maintain such large circular flow patterns as those shown in FIG. 1 with associated return transport of hot gas and generation of overpressure at the gas collecting hood on the side on which the covers are removed. On the side on which the covers are removed, the gas extraction will work under almost ideal conditions and the gas will take the path of least resistance, i.e. into the anode superstructure and straight up into the gas channel. As cold gas is heavier than hot gas, the "cold slip" and the gas extraction on the same side will work together and generate a speed vector which is directed into the anode superstructure and which is greatest parallel to the gas collecting hood 8' (horizontal gas collecting hood). The phenomenon is shown in principle by the vector indications in FIG. 2.

With such a flow director mounted centrally in the cell, the underpressure in the enclosure can be maintained more easily with a lower total extraction quantity than is the case without the flow director. In order for the system to work as intended, it is necessary for the underpressure at or under the gas collecting hood around the anode suspenders (not shown) on the side of the anode superstructure on which the covers have been removed to be of a certain size, for example greater than 3–4 Pa, so that process gas is kept inside the enclosure. With the flow director mounted, the emission to the hall atmosphere and thus the working environment will be improved and the gas extraction as a system will work better.

The flow director may also be established in another manner. For example, it is possible to place silos for feeding oxide, fluoride, etc. and other equipment inside the anode superstructure, which silos and equipment are adapted so that, from the point of view of flow, they will function as flow directors with regard to the transport of process gas from the anodes through the crust and cover material and to the extraction system, which takes care of the further transport of the gases, for example to purification or fluorine recovery. This can be done by the equipment physically dividing the furnace chamber into two separate parts, each connected to a separate extraction system which leads to the collection channel. Such division of the interior of the anode superstructure can be improved by the equipment as a whole constituting a tight wall along the entire length of the furnace chamber with a suitable opening down towards the electrolysis vessel so that a physical partition wall is formed equivalent to the flow director described above. To establish such a partition wall, any openings between the silos and other equipment can be sealed using sealing elements such as plates, etc. (not shown).

FIG. 3 shows details of an extraction system for use in accordance with the present invention. The figure shows a section of the anode superstructures 20, 21, 22, 23, 24 in accordance with FIGS. 1 and 2. As the figure shows, the anode superstructure 21 is equipped with two extraction channels 25, 26 which are connected to outlet connection pieces 27, 28 respectively. The connection pieces are connected to branches 33, 35 and 34, 36 respectively. Branches 35 and 36 are connected to a collection channel 29 for normal extraction, while branches 33 and 34 are connected to a channel 30 for forced extraction. Channel 30 can serve a given number of anode superstructures. An extraction fan 31 is mounted in the end of the channel and has an outlet which is connected to the collection channel. Moreover, a three-way valve (not shown) may be arranged in connection with the branch (at the transition between each of the outlet connection pieces 27, 28 and the branches 33, 35 and 34, 36 respectively).

The extraction system works as follows:

During normal operation, the process gases are extracted from the electrolytic cells via the anode superstructures 21 and outlet connection pieces 27, 28 and directly into collection channel 29 via branches 35 and 36. In this situation, the three-way valve is in such a position that it shuts off flow to branches 33, 34. If one or two or more covers in the anode superstructure are opened, extraction fan 31 starts and the process gases are sucked through branches 33 and 34 with the result that the speed and the volume sucked through outlet connection pieces 27 and 28 increase, for example to three times normal extraction. In this situation, no process gas passes through branches 35 and 36 as they are shut off by the three-way valve while tan 31 is in operation. Extraction fan 31 and channel 30, which constitute the primary components of the forced extraction, can be adapted so that they expediently cover the desired number of cells.

What is claimed is:

1. A method for the removal of process gases from electrolytic cells of type Hall-Héroult, where the cell comprises an anode superstructure with covers which can be opened for, among other things, access to the cell's anodes, and where the anode superstructure also comprises an extraction system for the removal of process gases having at least one outlet arranged in the upper part of the superstructure, characterised in that at least a part of the gas flow inside the superstructure will be horizontally directed away from the cover as it is opened, and further be directed upwards to the outlet of the extraction system at the opposite side of a centrally arranged flow directing structure.

2. A method in accordance with claim 1, characterised in that the extraction system extracts an increased quantity of process gases as one or more covers of the anode superstructure are opened.

3. A method in accordance with claim 1, characterised in that the gas flow inside the superstructure is further directed in a manner that air entering through an opening in the anode superstructure is removed mainly without returning back to said opening.

4. Means for use in connection with an electrolytic cell of type Hall-Héroult, comprising an anode superstructure with sides 2, 3, which has covers that can be opened, end walls, a bottom 6 facing down towards an electrolysis vessel and a top (7) connected to an extraction system for continuous extraction of process gases during the operation of the cell, the extraction system comprising at least one extraction opening arranged in the upper part of the superstructure, characterised in that the at least one extraction opening extends in the longitudinal direction of the cell, the cell further comprises a centrally arranged flow directing structure.

5. Means in accordance with claim 4, characterised in that the flow directing structure is constituted by an internal, vertical wall which extends down from the top of the anode structure towards the electrolysis vessel in the longitudinal direction of the cell.

6. Means in accordance with claim 5, characterised in that the vertical wall is mounted between two extraction openings in the top of the cell.

7. Means in accordance with claim 5, characterised in that the flow directing structure partly comprises process equipment such as a silo (silos) for feeding oxide and/or fluoride.

* * * * *